United States Patent [19]

Gundlach

[11] 4,233,151

[45] Nov. 11, 1980

[54] SHAKER MECHANISM FOR A STACK OF SIEVE TRAYS

[75] Inventor: John A. Gundlach, Everett, Wash.

[73] Assignee: Everett Metal Products, Everett, Wash.

[21] Appl. No.: 933,633

[22] Filed: Aug. 14, 1978

[51] Int. Cl.[3] ..... B07B 1/46

[52] U.S. Cl. ..... 209/319; 209/342; 209/237

[58] Field of Search ..... 209/437, 446, 315, 319, 209/237, 337, 338, 341, 342, 343, 363, 364; 220/3 C, 4 D; 206/821; 292/254, 113, 154

[56] References Cited

U.S. PATENT DOCUMENTS

| | | | |
|---|---|---|---|
| D. 183,323 | 8/1958 | Pomeroy | D54/2 |
| D. 183,324 | 8/1958 | Pomeroy | D54/2 |
| D. 196,266 | 9/1963 | Murphy | D54/2 |
| D. 203,480 | 1/1966 | Gardner | D55/1 |
| 289,187 | 11/1888 | Voith | 209/269 |
| 785,111 | 3/1905 | Lundqvist | 292/134 X |
| 857,942 | 6/1907 | Howard | 209/237 |
| 1,034,302 | 7/1912 | Rice | 209/343 |
| 1,122,803 | 12/1914 | Rhodes | 209/416 |
| 1,141,727 | 6/1915 | Seaman | 209/315 |
| 1,174,657 | 3/1916 | Bell | 209/237 |
| 1,291,371 | 1/1919 | Bell | 209/237 |
| 1,331,303 | 2/1920 | Wildhaber | 209/315 |
| 1,491,583 | 8/1924 | Cobb | 209/315 X |
| 1,910,294 | 5/1933 | Kaminski | 292/134 X |
| 1,991,001 | 2/1935 | Reynold | 209/237 |
| 2,029,848 | 2/1936 | Wettlaufer | 209/237 |
| 2,074,733 | 3/1937 | Porter | 209/330 |
| 2,075,097 | 3/1937 | Dawrs | 209/237 |
| 2,106,742 | 4/1938 | Hinkle | 209/342 X |
| 2,297,700 | 10/1942 | Hinkle | 209/342 X |
| 2,335,131 | 8/1944 | Kolleda | 209/237 |
| 2,358,453 | 9/1944 | Gilson | 209/319 |
| 2,384,715 | 9/1945 | Ward | 209/237 |
| 2,399,280 | 4/1946 | McDonnell | 209/315 |
| 2,623,656 | 12/1952 | Rottau | 220/40 X |
| 2,730,236 | 11/1956 | Missien | 209/237 |
| 2,748,942 | 6/1956 | Aker | 209/315 |
| 2,862,620 | 12/1958 | Van Zelst | 209/237 |
| 2,962,254 | 11/1960 | Parks | 248/358 |
| 3,006,384 | 10/1961 | Brown | 139/425 |
| 3,040,386 | 2/1972 | Frangos | 209/337 |
| 3,044,624 | 7/1962 | Parks | 209/412 |
| 3,045,824 | 7/1962 | Parks | 209/412 |
| 3,081,875 | 3/1963 | Parks | 209/412 |
| 3,098,837 | 7/1963 | Tonjes | 209/260 |
| 3,107,890 | 10/1963 | Parks | 248/358 |
| 3,109,808 | 11/1963 | Greenwell | 209/309 |
| 3,131,469 | 5/1964 | Glaze | 29/470.5 |
| 3,197,160 | 7/1965 | Murphy | 245/2 |
| 3,367,497 | 2/1968 | Louck | 209/319 |
| 3,367,498 | 2/1968 | Tonjes | 209/319 |
| 3,481,468 | 12/1969 | Tonjes | 209/237 |
| 3,804,246 | 4/1974 | Ljungqvist | 209/264 |

FOREIGN PATENT DOCUMENTS

| | | | |
|---|---|---|---|
| 840450 | 1/1939 | France | 209/342 |

*Primary Examiner*—Robert Halper
*Attorney, Agent, or Firm*—Delbert J. Barnard

[57] ABSTRACT

A stack of interfitting sieve trays are held in position on a carrier by an upstanding periperial wall on the carrier which engages the lower portion of the lower sieve tray, and by a plurality of clamp-down units which at their lower ends are pivotally connected to end portions of the carrier and at their upper ends include a lever operated hook mechanisms for engaging upper edge portions of the top sieve tray. Side edge portions of the carrier are provided with upper and lower bearing strips. These edge portions are received between upper and lower sets of cam rollers which are mounted onto web portions of side members which have been fashioned from channel stock. The side members carry bearing strips which contact and guide the side edges of the carrier. The clamp-down units are overweighted on their outer sides so that when released they will fall outwardly against stop means for limiting the amount of outward movement.

13 Claims, 12 Drawing Figures

SHAKER MECHANISM FOR A STACK OF SIEVE TRAYS

TECHNICAL FIELD

The present invention relates to apparatus for grading wood chips or the like as to size and shape. More particularly, it relates to a mechanism for shaking a stack of sieve trays, characterized by a simplicity of construction and by features which minimize the amount of lifting and other labor must be performed by the operator.

BACKGROUND ART

U.S. Pat. No. 3,804,246, granted Apr. 16, 1974, to Karl Johan Ljungqvist, discusses known procedures for analizing wood chips used in making pulp, as to size and shape. It and the Swedish Pat. No. 304,395 discussed therein each discloses a popular form of sieve analysis trays and an available mechanism for shaking the trays. A disadvantage of the tray shaking mechanism disclosed by these patents is that the support links for the tray carrier occupy space about the stack of trays and make it somewhat difficult for the operator to load and unload the sieve trays. Also, the sieve trays disclosed by these patents are fixed to one another and to the support frame or carrier by a large number of screw type connectors, each of which requires separate handling.

U.S. Pat. No. 2,355,131, granted Aug. 8, 1944, to Delmar Kolleda discloses a sieve analysis mechanism adopted for conducting fines tests of Portland cements, oars, fertalizers, sands and other dry comminuted materials. The apparatus includes mechanism for shaking a stack of relatively small diameter sieve trays. The sieve trays are supported on a reciprocating carrier which sets on four spaced apart rollers. Coil springs are interconnected between corner regions of the carrier and adjacent portions of a frame which surrounds the carrier. Owing to this arrangement, operation of the device is such that the sifter mechanism is subject to both lateral movement and arcuate movement. The arcuate movement is of a compound character for the reason that the sifter is pivoted about a first support during one portion of the rotation of the drive crank and pivots about your second rollers support during another portion of the same rotation of the drive crank. The particular mechanism disclosed by this patent is relatively easy to load and unload because it is open about the tray carrier and it includes but two clamp down units for securing the stack of sieve trays to the carrier. However, it is not constructed to carry the weight of a plurality of sieve trays of the type used in sieve analysis of pulp chips and it is not adapted for causing horizontal rectilinear translation of the sieve trays.

The above three patents and the following additional United States Patents should be studied for the purpose of putting the present invention into proper perspective relative to the prior art:

U.S. Pat. No. 857,942, granted June 25, 1907, to William B. Howard; No. 1,141,727, granted June 1, 1915, to Alexander F. Seaman; No. 1,291,371, granted Jan. 14, 1919, to John W. Bell; No. 1,331,303, granted Feb. 17, 1920, to C. Wildhaber; No. 1,491,483, granted Apr. 1924, to Henry C. Cobb; No. 2,074,733, granted Mar. 23, 1937, to Donald C. Porter; No. 2,074,097, granted Mar. 30, 1937, to Harvey P. Dawrs and Henry R. Power; No. 2,358,453, granted Sept. 19, 1944, to Seth J. Gilson; No. 2,384,715, granted Sept. 11, 1945, to Royal V. Ward; No. 2,399,280, granted Apr. 30, 1946, to Hubert F. McDonell; No. 2,730,236, granted June 5, 1956, to Sam C. Aker; No. 3,098,037, granted July 15, 1963, to Robert A. Kline and Burl D. Tonjes; and No. 3,314,539, granted Apr. 18, 1967, to Earl R. Hitchman.

DISCLOSURE OF INVENTION

The sieve tray shaking mechanism of the present invention is basically characterized by a frame which includes a pair of spaced apart side members. A carrier for a stack of sieve trays is positioned between the side members and is mounted onto inner portions of such side members for horizontal rectilinear translation. The sieve tray carrier is provided with a plurality of clamp down units, each of which includes a lower end which is pivotally connected to a border portion of the carrier and an upper end which is engageable with the upper sieve tray of the stack. The upper edges of the frame side member are preferably positioned a level below the waist of the user so that the user need not lift the sieve trays an appreciable amount when moving them over a said side member upper edge onto or off of the carrier.

According to an important aspect of the invention, each side member includes a side wall and a top flange defining its upper edge. The top flange projects laterally inwardly from the top of the side wall. The carrier is supported by anti-friction rollers which are mounted on the side wall closely below the flange. The carrier includes a border portion at each side which also functions as a support rail for the carrier. The carrier further includes restraining means for engaging the lower portion of a stack of sieve trays and preventing horizontal movement of the sieve trays while on the carrier. The side boundaries of the restraining means are closely adjacent to the inner boundaries of the top flange.

According to another aspect of the invention, the rollers are metal cam rollers and each support rail includes a detachable lower bearing strip in contact with the lower rollers and detachable upper bearing strip in contact with the upper rollers. The bearing strips are constructed from plastic for the purpose of reducing noise and wear.

According to yet another aspect of the invention, a detachable bearing strip is located vertically between the upper and lower rollers and laterally outwardly from the side boundary of each support rail. These bearing strips are positioned to serve as slide bearings for the side boundaries of the carrier. The overall arrangement provides a quite simple and inexpensive, yet effective, way of supporting and guiding the carrier for horizontal rectalinear translation.

According to yet another aspect of the invention, the rollers include means for moveably securing them to the side walls of the side members. The frame includes a removeable end member which is normally secured to the ends of the side members at one end of the frame. Owing to the arrangement of the rollers and the carrier, following removal of the end member the carrier can be pulled out like a drawer and removed from the mechanism. This would be done whenever it would be necessary to provide access to the rollers and/or the bearing strips carried by the side members of the frame and/or the bearing strips carried by the support rail portions of the carrier. Such access would be required from time to time for purposes of maintenance of the mechanism, e.g. replacement of a roller or a bearing strip, etc.

According to a further but quite important aspect of the invention, each clamp-down unit is provided with stop means for preventing its outward pivotal movement beyond a predetermined outwardly leaning position. Thus, the clamp-down units can be easily and quickly moved out of the way when it becomes necessary to add or remove the sieve trays. Yet, the clamp-down units remain in close proximity to their use positions so that the operator does not have to stoop down and pick them up preparatory to using them.

In preferred form each clamp-down unit includes a toggle clamp mechanism at its upper end. Such a mechanism is per se old and includes hook means for engaging an edge (in this installation the upper edge portion of the upper sieve tray) and control handle means moveable angular between two positions for engaging and disengaging the hook means.

Preferably also each clamp-down unit is overweighted on its outward side, so that when released it will automatically swing outwardly into an outwardly leaning position against its said stop means.

Preferably also, each clamp-down unit is adjustable in length so that different heights of the sieve tray stack can be accomodated.

Of course, there are other features of the illustrated embodiment which constitute important parts of the present invention. These features are set forth in detail below, as a part of the discription of the illustrated embodiment.

BEST MODE FOR CARRYING OUT THE INVENTION

Figure 1:
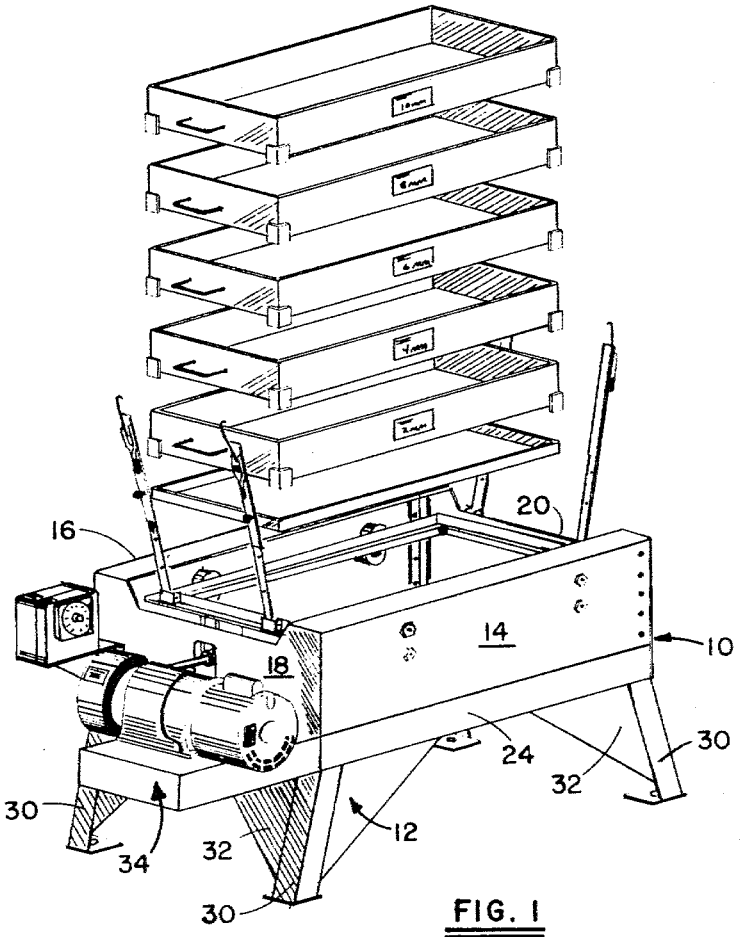
FIG. 1 is an exploded isometric view of an embodiment of the sieve tray shaking mechanism of the present invention.

The drawing figures show one embodiment of the present invention which at the time of filing constitutes the best known mode for carrying out the invention.

Figure 3:
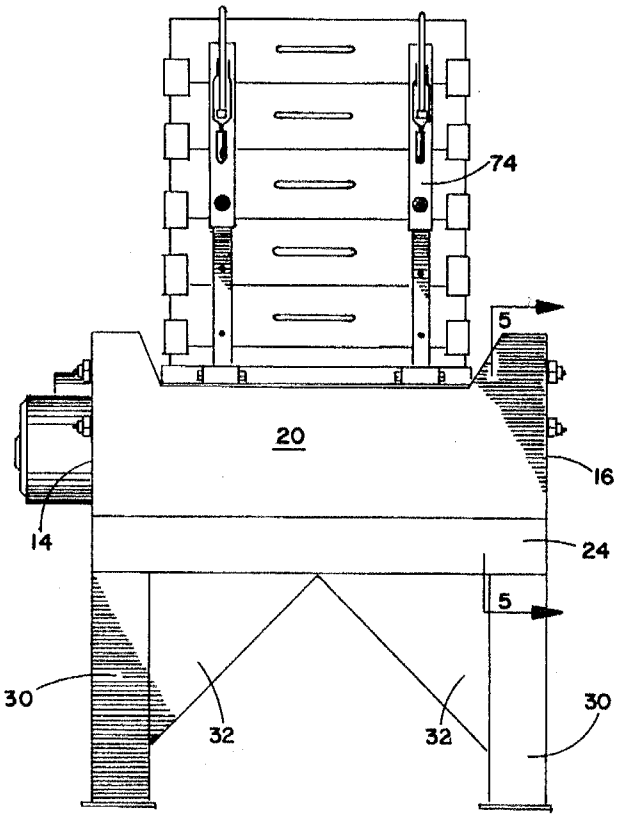
FIG. 3 is an end elevational view of the sieve tray shaking mechanism of FIGS. 1 and 2.
Figure 2:
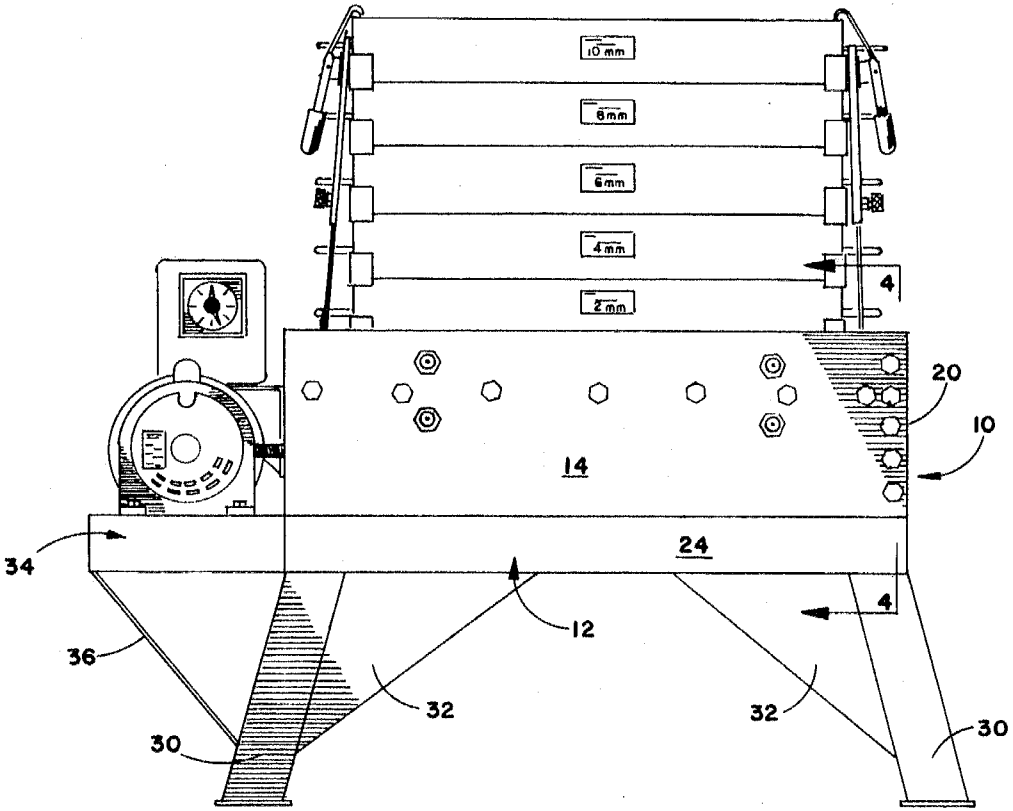
FIG. 2 is a side elevational of the sieve tray shaking mechanism of FIG. 1.

Referring first to FIGS. 1–3, the illustrated embodiment of sieve tray shaker is shown to include a frame 10 which includes a supporting base 12.

The upper portion of frame 10 comprises a pair of side members 14, 16 and pair of end members 18, 20. Preferably, the side members 14, 16 are constructed from lengths of channel stock. The lower flanges 22 (FIG. 4) of members 14, 16 may rest on and be connected to one side of a corresponding length of angle iron 24. Angle iron member 24 is a part of a subframe which extends around the entire perimeter of the frame 10. The second side 26 of the angle iron 24 depends from the side member 14 [or 16] and is coplanar with the web portion 28 of side member 14 [or 16].

The supporting base 12 may comprise four legs 30, constructed from the same size angle iron stock that is used for the subframe 24, and a plurality of plate metal gussets 32 which are welded to both the legs 30 and subframe. A motor support shelf 34 is provided at one end of the frame same size angle iron material and a bracket 36 connected between it and the legs 30 at its end of frame 10.

End member 18 at the shelf end of frame 10 may be permanently connected to side members 14, 16. Preferable, the opposite end member 20 is removeably secured to its end. of side members 14, 16.

Figure 6:
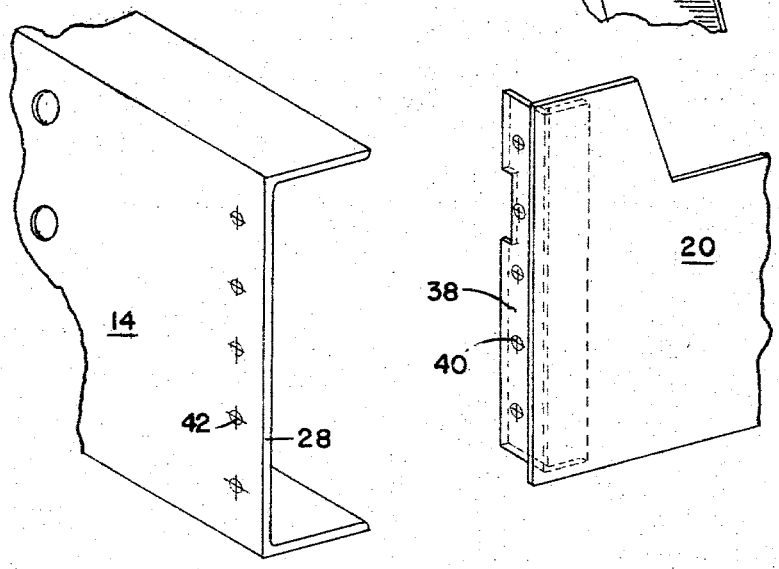
FIG. 6 is an exploded fragmentary isometric view of an upper corner region of the frame at the removeable end of the frame.

As best shown by FIGS. 3 and 6, end member 20 may be fashioned from plate steel and may be provided with a bolting flange 38 at each end. As shown by FIG. 6, a length of angle iron may be used for providing the bolting flanges 38. One side of the angle iron may be drilled to include holes 40 registrable with complimentary holes 42 provided in the web portion of the side members 14 (and 16). The second side of the angle iron member may be welded to an end portion of end wall 20. The placement of the angle iron member on end member 20 is such that when the end member 20 is set in place the bolting flange 38 is contiguous the inner surface of web 28 and the holes 40 are in register with the hole 42.

As will be apparent, removal of the end member 20 will make the inner space of the frame 10 accessable. This is important because according to the present invention a seive tray carrier 44 is located within said inner space, between the side members 14, 16.

Figure 4:
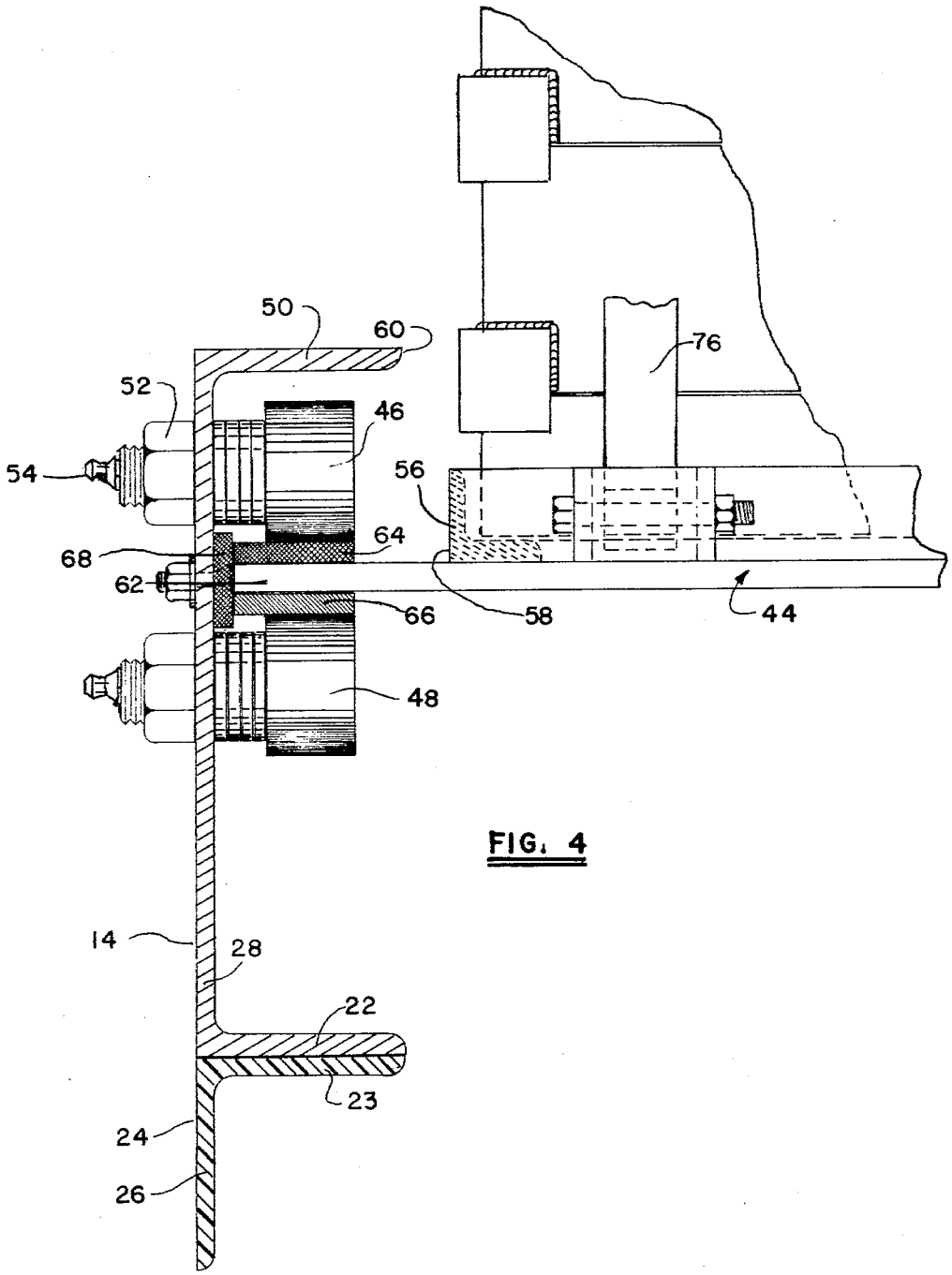
FIG. 4 is an enlarged scale sectional view taken through an upper corner portion of the frame, substantially along line 4—4 of FIG. 2.
Figure 5:
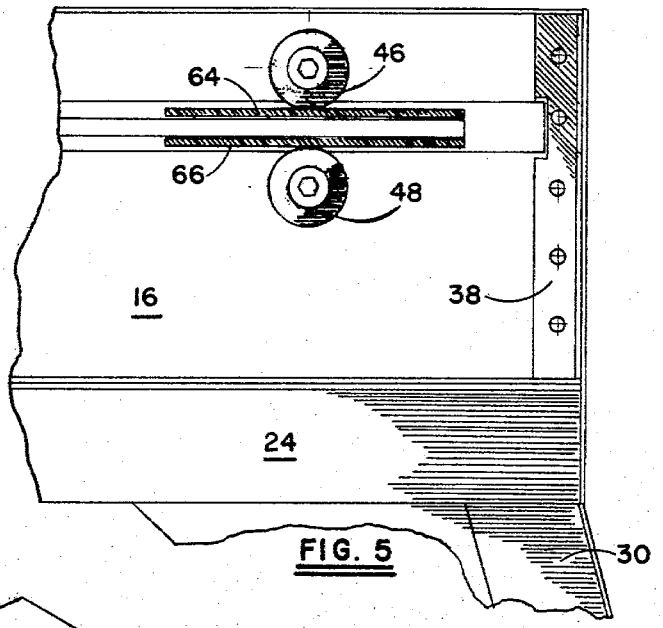
FIG. 5 is a fragmentary sectional view taken through an upper portion of the frame, substantially along 5—5 of FIG. 3.

As shown by FIG. 4, upper and lower sets of cam rollers 46, 48 or the like may be bolted to upper and mid portions of each side member web 28. Side members 14, 16 each include, a top flange 50 which defines its top edge. As shown by FIG. 4, the top flange 50 projects laterally inwardly from the top of web 28 over the top set of rollers 46.

Preferably, the rollers 46, 48 are cam rollers or followers of a type having an overhung mount. The mount includes a central shaft having a shank portion which extends through an opening formed in the web 28. The free end of the shaft threaded and receives a nut 52 which when tightened firmly secures the shaft to the web 28. The wheel portion of the cam roller is supported for rotation by a set of needle bearings. The support shaft is hollow and includes a grease fitting 54 at its outer end by way of which grease is supplied to the bearings.

The use of cam followers for the rollers 46, 48 presents several advantages. Firstly, the units are readily available off-the-shelf items and hence are relatively inexpensive. Despite the fact that they are relatively inexpensive, they are constructed quite well, and can carry large radial loading, and have a good resistance to shock. They are easy to mount and in particular can be easily mounted onto the web portion of a channel member.

The carrier 44 is also quite simple in its makeup. It comprises an open centered plate body reinforced by an angle iron frame 56 which also functions as a restraint for the stack of sieve trays. As best shown by FIG. 4, the side boundary 58 of the sieve tray restraining means is laterally quite close to the inner boundary 60 of the top flange 50 of side member 14 (or 16).

The side border portions 62, 63 of the carrier 44 constitute slide mounts for the carrier 44. They include upper and lower bearings strips 64, 66 which may be constructed from one quarter inch polyurethane plastic. According to an aspect of the invention, a third bearing strip 68 is secured to the inside of web 28, at a location that is between the rollers 46, 48. This bearing strip 68 may also be constructed from one quarter inch polyurethane plastic. It makes a sliding contact with the (side edge of slide mount 62 (or 63).

When the end wall 20 is removed and the drive mechanism 71 is disconnected from the carrier 44 the carrier 44 can be moved like a drawer out from its in use position between the rollers 46, 48. Then, the cam rollers 46, 48 and the bearing strip 68 are readily accessable for servicing or replacement. The bearing strips 64, 66 on the removed carrier 44 are also readily accessable for servicing or replacement.

Figure 7:
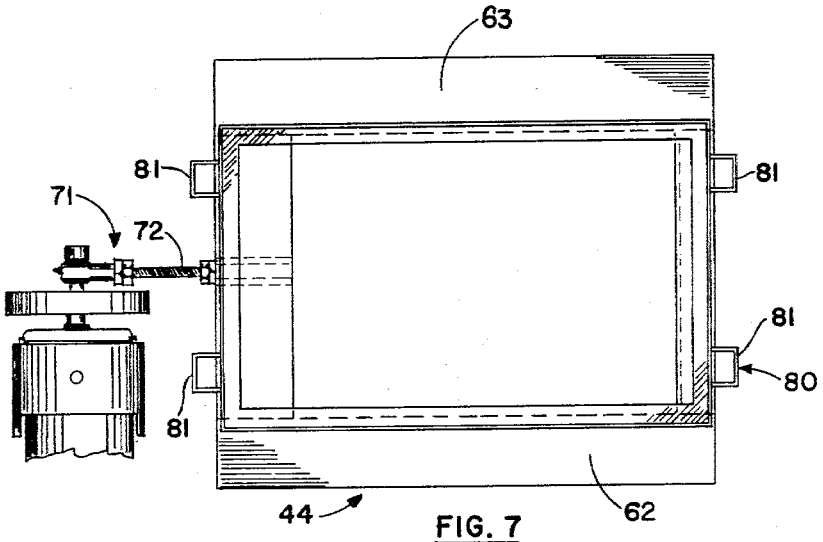
FIG. 7 is a top plan view of the sieve tray carrier.
Figure 8:
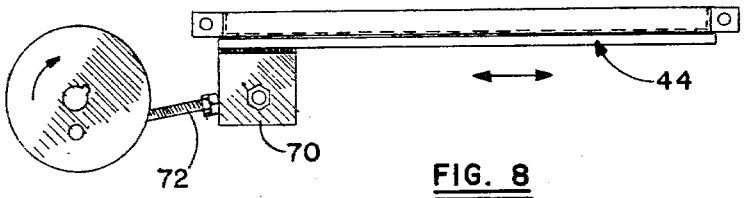
FIG. 8 is an side elevational view of the carrier; substantially along line 8—8 of FIG. 7.
Figure 9:
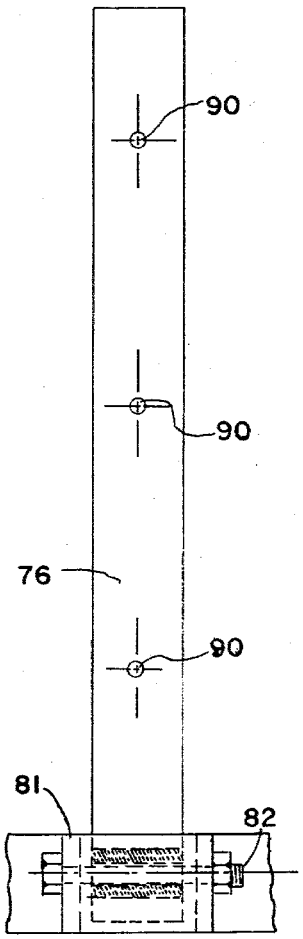
FIG. 9 is an end elevational view of the lower portion a clamp-down unit.

When the carrier 44 is positioned for use between the rollers 46, 48, the side portions thereof are protectively housed by the channel construction of the side members 14, 16. A reciprocating drive arm 72 is attached to a central end portion of carrier 44. As shown by FIGS. 7 and 8, the carrier 44 may be provided with a pair of vertically depending plates 70 which are welded along their upper edges to a central end portion of carrier 44. An end portion of the reciprocating drive arm 72 extends between the plates 70 and is pivotally connected thereto by means of a cross pin.

The rectangular shape of the carrier 44 and close fit of its side edges between the two bearing strips 68 cause the carrier 44 to be guided for horizontally rectilinear translation. The close spacing of the tray receiving central portion of carrier 44 below the top flanges 50 minimizes the amount of lifting that is necessary in order to move a sieve tray over a side member and into a position on the carrier 44, within the confines of the restraining means 56. However, the carrier 44 is still offset downwardly enough from the flanges 50 that carrier 44 is well housed.

According to an aspect of the invention, it is quite imortant that the operator can readily move the sieve trays onto and off from the carrier 44 with a minimum amount of inconvenience and lifting. The construction of the shaker mechanism of this invention makes that possible. The upper edge or top flange portion 50 of the frame can is spaced above the floor at a level which is below the waist of the operator (e.g. about twenty-five inches above the floor). This means that the operator does not have to lift any of the sieve trays any appreciable distance. Owing to the construction of the frame 10, the first sieve tray need be lifted only an amount necessary for it to clear the upper portion of a side member 14 (or 16). If necessary, or if convenient to the operator, such tray may be set down onto the top flange 50 while it is being handled. Once the operator has moved a tray over the top flange 50 he does not have to lower it any appreciable amount in order to set it down onto the carrier 44.

According to another aspect of the invention, operator convenience is enchanced by the provision of plurality of clamp - down units 74 which are permanantly secured to the carrier and are always in ready reach of the operator. At the same time they have inoperative positions in which they are out of the way of the operator so that they do not impede loading or unloading of the sieve trays. Each clamp-down unit 74 is provided with a lever control which can be easily thrown for the purpose of connecting or disconnecting the stack of sieve trays. Also, each clamp-down unit 74 is adjustable in length so that different heights of sieve trays can be accomodated on the carrier 44.

Figure 10:
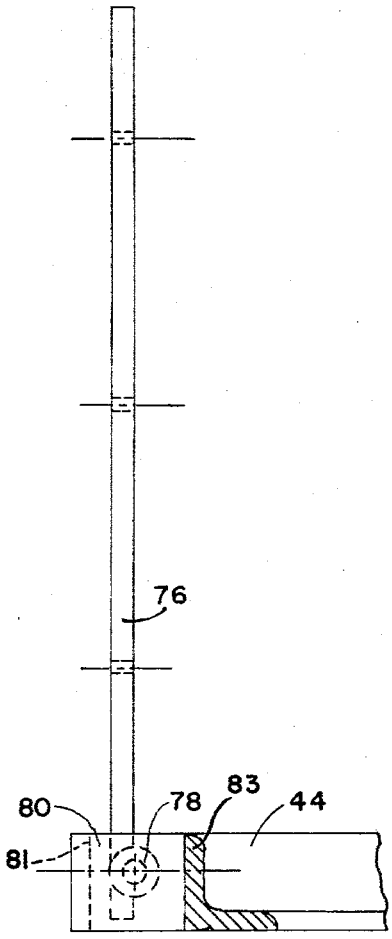
FIG. 10 is a side elevational view of the apparatus shown by FIG. 9.
Figure 11:
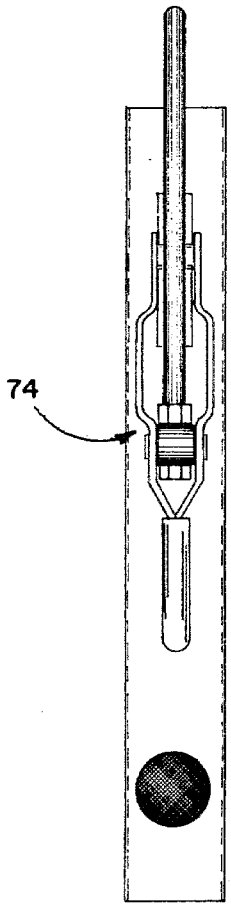
FIG. 11 is an end elevational view of the upper portion of a clamp-down unit.
Figure 12:
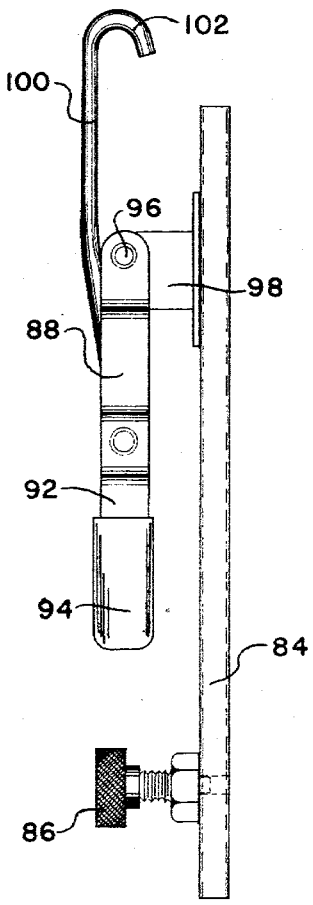
FIG. 12 is a side elevational view of the apparatus of FIG. 11.

Referring now to FIGS. 8–12, in particular, the carrier 44 may be provided with a pair of laterally spaced apart clamp-down units 74 at each of its ends. Each unit 74 may comprise a lower portion 76 in the form of a rectangular bar FIGS. 9 and 10. A cylindrical sleeve 78 may be welded or be otherwise secured to the lower end of each bar 76. The sleeve portion 78 of each bar 76 is received within a box-like socket 80 having side walls for carrying a cross-pin 82. Pin 82 extends through the cylindrical member 78 and pivotally connects the lower end of the bar 76 to the carrier 44. As shown by FIG. 10, the other two walls of the socket 80 provide stops 81, 83 for limiting the amount of pivotal movement of the bar 76.

The upper portion of each bar 76 is telescopically received within a tubular member 84 which carries a lock pin 86 at its lower end and a toggle type clamp mechanism 88 at its upper end. The bar 76 is provided with a plurality of spaced apart openings 90 and the lock bolt 86 is selectively moveable into these openings 90. The spacing of the openings is related to the height of the sieve trays. The illustrated embodiment includes three openings, adapting the clamp-down units 74 for use with three different heights of the sieve tray stack.

Preferably, the lock pin is in the nature of a hand rectractable spring plunger of the type sold by Reid Tool Supply Company of Muskegon Heights, Michigan 49444. The pin that is being used is identified as PHR—4½–13 on page 128 of the Reid Cat. No. 178—March 1978. This type of pin is spring biased inwardly. It need only be pulled out by hand to disengage its end and permit movement of member 84, when a new hole in bar 76 is reached, the spring will automatically move pin 86 into it.

The toggle-type clamp mechanism 88 at the top of the clamp-down unit 74 is conventional per se. It comprises a lever having a handle 94 at one end and means 96 pivotally mounting its opposite end to a support post 98 which is secured to the lever 92. The opposite or upper end of the hook member 100 is curved inwardly to form a hook 102. When the lever 92 is lifted it in turn lifts the hook 102 out of engagement with the edge portion of the upper sieve tray. When the lever 92 is swung downwardly into the position shown by FIGS. 11 and 12, it pulls the hook 102 downwardly and into engagement with the edge portion of the upper sieve tray.

As shown by FIGS. 1 and 3, the lever mechanism is positioned on the outward side of the tubular member 84. As a result, each clamp-down unit 79 is overweighted on its outer side. Thus, when a clamp-down unit 74 is disconnected from a stack of trays and released it will tend to fall outwardly and will in fact fall outwardly until further movement is arrested by the stops 81. When the clamp-down units 74 are leaning against the stops 81 they are out of the way so that the operator can easily load or unload the sieve trays from one side of the mechanism. At the same time the clamp-down unit 74 are readily accessable so that they can be grabbed and swung inwardly and secured to a stack of sieve trays without it being necessary for the operator to first reach for them.

INDUSTRIAL APPLICABILITY

The shaker mechanism of the present invention was especially developed for use in the pulp and paper industry by those persons charged with analyzing wood chips which are to be used foı making pulp. However, the mechanism may also be used for shaking a stack of sieve trays providing for separation or grading other substances which involve the same type of sieve tray handling problems.

What is claimed is:

1. Mechanism for shaking a stack of sieve trays, comprising:

a frame including a pair of spaced apart side members and a supporting base;

a carrier for a stack of sieve trays positioned between said spaced apart side members;

means mounting said carrier onto inner portion of said frame side members, for horizontal rectilinear translation, said means comprising support rails and anti-friction rollers in rolling contact with said support rails;

power drive means for translating the carrier and any sieve trays mounted thereon back-and-forth;

means for securing a stack of sieve trays onto said carrier, comprising a plurality of clamp-down units, each having a lower end which is pivotally connected to a border portion of the carrier and an upper end which is engageable with the upper sieve tray of a stack of sieve trays that is supported on the carrier;

said frame side members having upper edges which are at a level below the waist of a user, so that the user need not lift the sieve trays an appreciable amount when moving them over a said side member upper edge onto or off from the carrier;

each said side member including a side wall and a top flange defining its upper edge, projecting laterally inwardly from the upper top of the side wall;

said anti-friction rollers being mounted on said side wall closely below said flange;

said support rail being a side border portion of the carrier;

said carrier including restraining means for engaging the lower portion of the stack of sieve trays and preventing horizontal movement of the sieve trays while on the carrier, said restraining means including a side boundary which is closely adjacent the inner boundary of said top flange;

said anti-friction roller means comprising a lower set of horizontal spaced apart rollers and an upper set of horizontally spaced apart rollers;

said support rail being positioned vertically between said upper and lower sets of rollers;

said rollers being metal cam rollers; and each said support rail including a detachable lower bearing strip in contact with the lower rollers and a detachable upper bearing strip in contact with the upper rollers, said bearing strips being constructed from a structural plastic material.

2. Mechanism according to claim 1, wherein each said side member includes a detachable bearing strip which is located vertically between the upper and lower rollers and laterally outwardly from the side boundary of each support rail, each such bearing strip being positioned to serve as a slide bearing for the side boundaries of the carrier.

3. Mechanism according to claim 2, wherein the rollers include means for removeably securing them to the side walls of the side members, and wherein said frame includes an end member and means for removeably securing it to the ends of the side members at one end of the frame, wherein when said end member is removed the carrier can be pulled out like a drawer and removed from the mechanism, to provide access to the rollers and/or bearing strips carried by the side members of the frame and/or the bearing strips carried by support rail portions of the carrier.

4. Mechanism according to claim 3, wherein each said clamp-down unit is adjustable in length for accomodating heights of the stack of sieve trays.

5. Mechanism according to claim 3, wherein each clamp-down unit includes a toggle clamp mechanism at its upper end, including hook means for engaging an upper edge portion of the upper sieve tray and control handle means moveable angularly between two positions for engaging and disengaging the hook means.

6. Mechanism for shaking a stack of sieve trays, comprising:

a frame including a pair of spaced apart side members and a supporting base;

a carrier for a stack of sieve trays positioned between said spaced apart side members;

means mounting said carrier onto inner portion of said frame side members, for horizontal rectilinear translation, said means comprising support rails and anti-friction rollers in rolling contact with said support rails;

power drive means for translating the carrier and any sieve trays mounted thereon back-and-forth;

means for securing a stack of sieve trays onto said carrier, comprising a plurality of clamp-down units, each having a lower end which is pivotally connected to a border portion of the carrier and an upper end which is engageable with the upper sieve tray of a stack of sieve trays that is supported on the carrier;

said frame side members having upper edges which are at a level below the waist of a user, so that the user need not lift the sieve trays an appreciable amount when moving them over a said side member upper edge onto or off from the carrier;

each said side member including a side wall and a top flange defining its upper edge, projecting laterally inwardly from the upper top of the side wall;

said anti-friction rollers being mounted on said side wall closely below said flange;

said support rail being a side border portion of the carrier;

said carrier including restraining means for engaging the lower portion of the stack of sieve trays and preventing horizontal movement of the sieve trays while on the carrier, said restraining means including a side boundary which is closely adjacent the inner boundary of said top flange;

said anti-friction roller means comprising a lower set of horizontal spaced apart rollers and an upper set of horizontally spaced apart rollers; and said support rail being positioned vertically between said upper and lower sets of rollers.

7. Mechanism for shaking a stack of sieve trays, comprising:

a frame;

a carrier for a stack of sieve trays;

means mounting said carrier onto said frame for horizontal rectilinear translation at a level below the waist of a user, so that the user need not lift the sieve trays an appreciable amount moving them onto or off from the carrier;

power drive means for translating the carrier and any sieves mounted thereon back-and-forth;

means for securing a stack of sieve trays onto said carrier, comprising at least one elongated bar-like clamp-down unit at each end of the carrier, each said clamp-down unit having a lower end which is pivotally connected to a border portion of the carrier and an upper end which is engagable with the upper sieve tray of a stack of sieve trays that is supported on the carrier;

said carrier including stop means for preventing outward movement of each clamp-down unit beyond a predetermined outwardly leaning position; and each clamp-down unit being overweighted on its outward side, so that when released it will automatically swing outwardly into an outwardly leaning position against its said means.

8. Mechanism according to claim 7, wherein each said clamp-down unit is adjustable in length for accomodating differing heights of the stack of sieve trays.

9. Mechanism according to claim 7, wherein each clamp-down unit includes a toggle clamp mechanism at its upper end, including hook means for engaging an upper edge portion of the upper sieve tray and control handle means moveable angularly between two positions for engaging and disengaging the hook means.

10. Mechanism for shaking a stack of sieve trays, comprising:

a frame including a pair of spaced apart side members and a supporting base;

a carrier for a stack of sieve trays positioned between said spaced apart side members;

means mounting said carrier onto inner portion of said frame side members, for horizontal rectilinear translation, said means comprising support rails and anti-friction rollers in rolling contact with said support rails, said anti-friction rollers comprising a lower set of horizontal spaced apart rollers and an upper set of horizontally spaced apart rollers, said support rail being positioned vertically between said upper and lower sets of rollers;

said rollers being metal cam rollers and each said support rail including a detachable lower bearing strip in contact with the lower rollers and a detachable upper bearing strip in contact with the upper rollers, said bearing strips being constructed from a structural plastic material;

power drive means for translating the carrier and any sieve trays mounted thereon back-and-forth; and means for securing a stack of sieve trays onto said carrier.

11. Mechanism according to claim 10, wherein said frame side members includes upper edges which are at a level below the waist of a user so that the user need not lift the sieve trays an appreciable amount when moving them over a said side member upper edge onto or off from the carrier.

12. Mechanism according to claim 10, wherein each said side member includes a detachable bearing strip which is located vertically between the upper and lower rollers and laterally outwardly from the side boundary of each support rail, each such bearing strip being positioned to serve as a slide bearing for the side boundaries of the carrier.

13. Mechanism according to claim 10, wherein each said side member includes a side wall and a top flange defining its upper edge, projecting laterally inwardly from the upper top of the side wall, wherein said anti-friction rollers are mounted on said side wall closely below said flange, wherein said support rail is a side border portion of the carrier, and wherein said carrier includes restraining means for engaging the lower portion of the stack of sieve trays and preventing horizontal movement of the sieve trays while on the carrier, said restraining means including a side boundary which is closely adjacent the inner boundary of said top flange.

* * * * *